US010940707B2

(12) United States Patent
Fujisawa et al.

(10) Patent No.: US 10,940,707 B2
(45) Date of Patent: Mar. 9, 2021

(54) PHOTO-CURING INKJET PRINTER

(71) Applicant: Roland DG Corporation, Hamamatsu (JP)

(72) Inventors: Yuta Fujisawa, Hamamatsu (JP); Bunji Shinomiya, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/720,028

(22) Filed: Dec. 19, 2019

(65) Prior Publication Data

US 2020/0207127 A1 Jul. 2, 2020

(30) Foreign Application Priority Data

Dec. 26, 2018 (JP) ..... JP2018-243625

(51) Int. Cl.

| | |
|---|---|
| ***B41J 11/00*** | (2006.01) |
| ***B41J 13/00*** | (2006.01) |
| ***B41J 11/06*** | (2006.01) |
| *B41J 2/01* | (2006.01) |
| *B41J 29/393* | (2006.01) |

(52) U.S. Cl.

CPC ..... *B41J 13/0009* (2013.01); *B41J 11/00* (2013.01); *B41J 11/002* (2013.01); *B41J 11/06* (2013.01); *B41J 2/01* (2013.01); *B41J 29/393* (2013.01)

(58) Field of Classification Search

CPC ..... B41J 13/0009; B41J 11/06; B41J 11/002; B41J 11/00; B41J 2/01; B41J 29/393

See application file for complete search history.

(56) References Cited

U.S. PATENT DOCUMENTS

2006/0007290 A1* 1/2006 Oshima ..... B41J 11/002 347/102
2007/0188578 A1* 8/2007 Kayanaka ..... B41J 11/06 347/104
2012/0281049 A1* 11/2012 Kachi ..... B41J 11/002 347/102

FOREIGN PATENT DOCUMENTS

JP 2015-182249 A 10/2015

* cited by examiner

*Primary Examiner* — Yaovi M Ameh
(74) *Attorney, Agent, or Firm* — Keating & Bennett, LLP

(57) ABSTRACT

A photo-curing inkjet printer includes a bed, a discharger, a light applicator, and a conveyor. The bed includes a printable region defined in advance. A substrate is placed on the bed. The discharger discharges photo-curable ink. The light applicator applies light. The conveyor conveys one of the bed and the discharger relative to the other one of the bed and the discharger in a conveyance direction. The discharger includes a row of nozzles aligned in the conveyance direction. The nozzles discharge the photo-curable ink. A length of the bed measured from a start end of the bed to a start end of the printable region is longer in the conveyance direction than a length calculated by subtracting a maximum pass width from a length of the row of nozzles of the discharger.

8 Claims, 7 Drawing Sheets

PHOTO-CURING INKJET PRINTER

CROSS REFERENCE TO RELATED APPLICATIONS

This application claims the benefit of priority to Japanese Patent Application No. 2018-243625 filed on Dec. 26, 2018. The entire contents of this application are hereby incorporated herein by reference.

BACKGROUND OF THE INVENTION

1. Field of the Invention

The present invention relates to photo-curing inkjet printers.

2. Description of the Related Art

Photo-curing inkjet printers known in the related art include a bed, a discharger, a light applicator, and a conveyor. A substrate is placed on the bed. The discharger includes nozzles to discharge photo-curable ink onto the substrate placed on the bed. The light applicator applies light to the photo-curable ink discharged onto the substrate. The conveyor conveys the bed in a conveyance direction. Such a photo-curing inkjet printer is disclosed, for example, in JP 2015-182249 A. The photo-curing inkjet printer applies light to photo-curable ink on a substrate such that the photo-curable ink is cured and fixed onto the substrate.

Some of the photo-curing inkjet printers known in the related art further include a casing including a bottom wall made of, for example, sheet metal. The length of the bed measured in the conveyance direction may be shorter than the length of the bottom wall measured in the conveyance direction. In effecting printing on the start end of a printable region, for example, in the initial stage of printing, light applied from the light applicator of such a photo-curing inkjet printer may be incident on and reflected by the bottom wall of the casing. Research conducted by the inventors suggests that the reflection angle of light reflected by the bottom wall is relatively greater than the reflection angle of light reflected by the bed. The light reflected by the bottom wall may thus be also incident on the discharger. Repeating printing operations in this state may cure ink inside the nozzles of the discharger and/or ink adjacent to openings of the nozzles. This may make it likely that a discharge failure will occur, making it necessary to frequently clean the discharger.

SUMMARY OF THE INVENTION

Accordingly, preferred embodiments of the present invention provide photo-curing inkjet printers that are each unlikely to suffer a discharge failure in discharging photo-curable ink.

A preferred embodiment of the present invention provides a photo-curing inkjet printer including a casing, a bed, a discharger, a light applicator, a conveyor, and a controller. The casing includes a bottom wall. The bed is disposed above the bottom wall. The bed includes a printable region defined in advance. A substrate is placed on the bed. The discharger is disposed above the bed. The discharger discharges photo-curable ink onto the substrate placed on the bed. The light applicator is disposed above the bed. The light applicator applies light to the photo-curable ink discharged onto the substrate. The conveyor conveys one of the bed and the discharger relative to the other one of the bed and the discharger in a conveyance direction. The controller controls the discharger, the light applicator, and the conveyor. A length of the bottom wall is longer than a length of the bed in the conveyance direction. The discharger includes a row of nozzles aligned in the conveyance direction. The nozzles discharge the photo-curable ink. A length of the bed measured from a start end of the bed to a start end of the printable region is longer in the conveyance direction than a length calculated by subtracting a maximum pass width from a length of the row of nozzles of the discharger.

The printer according to the above preferred embodiment is configured such that if the light applied from the light applicator is reflected by the bottom wall of the casing in the initial stage of printing, the reflected light would be blocked by the bed and would be unlikely to reach the nozzles of the discharger. This reduces the amount of reflected light incident on the nozzles. Thus, repeating printing operations is more unlikely to clog the nozzles than when the length of the bed measured from its start end to the start end of the printable region is shorter than the length calculated by subtracting the maximum pass width from the length of the row of nozzles of the discharger. This enables the discharger to more stably discharge the ink. Consequently, the printer according to the above preferred embodiment reduces the frequency of cleaning for the discharger so as to reduce the time required for cleaning and reduce ink consumption.

Various preferred embodiments of the present invention provide photo-curing inkjet printers that are each unlikely to suffer a discharge failure in discharging photo-curable ink.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described below with reference to the drawings. The preferred embodiments described below are naturally not intended to limit the present invention in any way. Components or elements having the same functions are identified by the same reference signs, and description thereof will be omitted or simplified when redundant.

Figure 1:
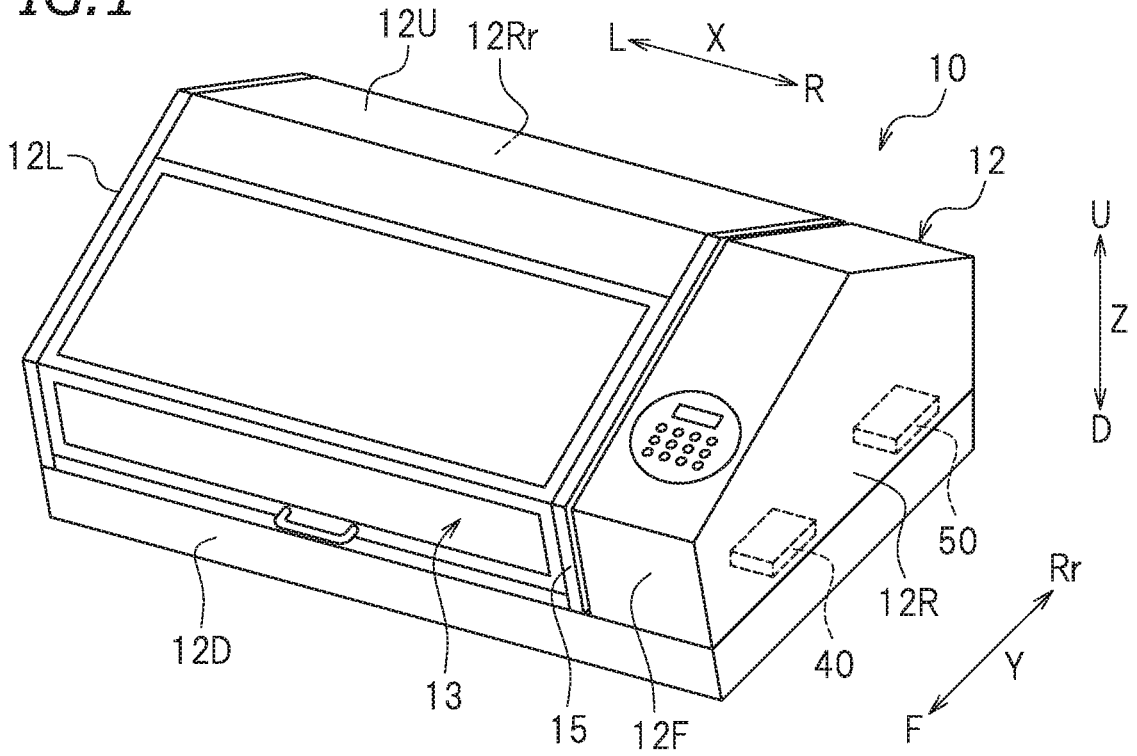
FIG. 1 is a perspective view of a photo-curing inkjet printer according to a preferred embodiment of the present invention.
Figure 2:
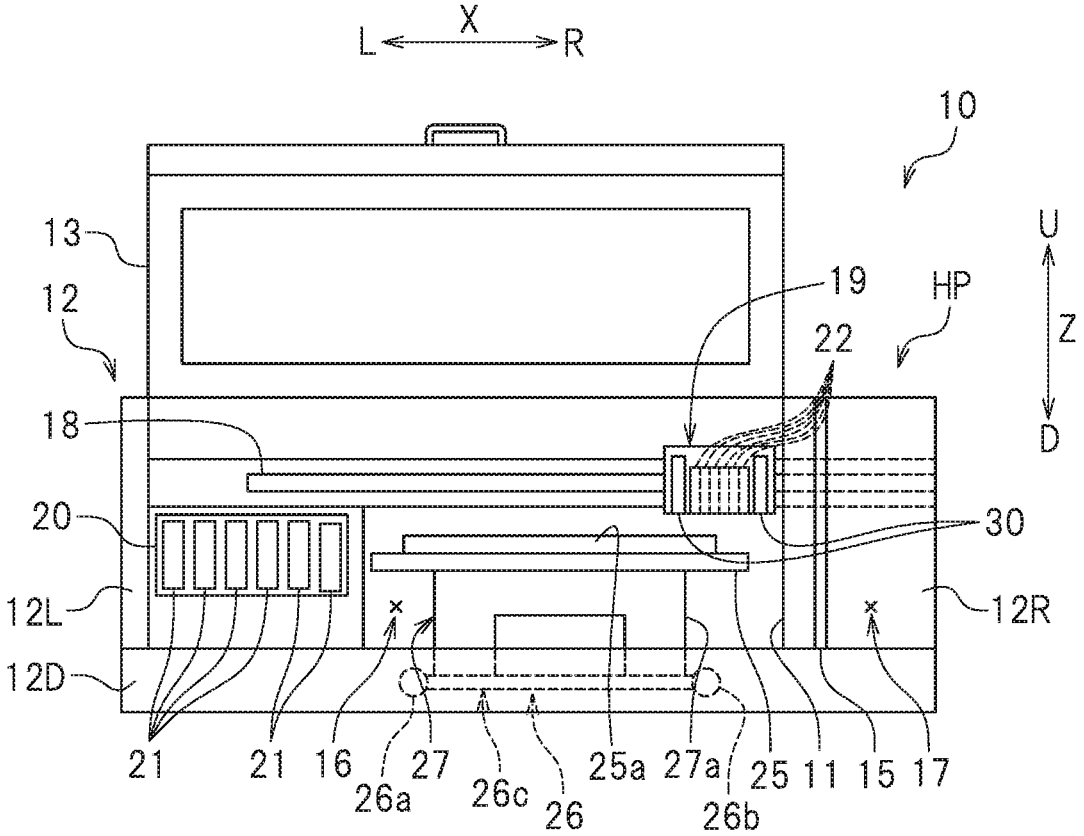
FIG. 2 is a front view of a photo-curing inkjet printer according to a preferred embodiment of the present invention.
Figure 3:
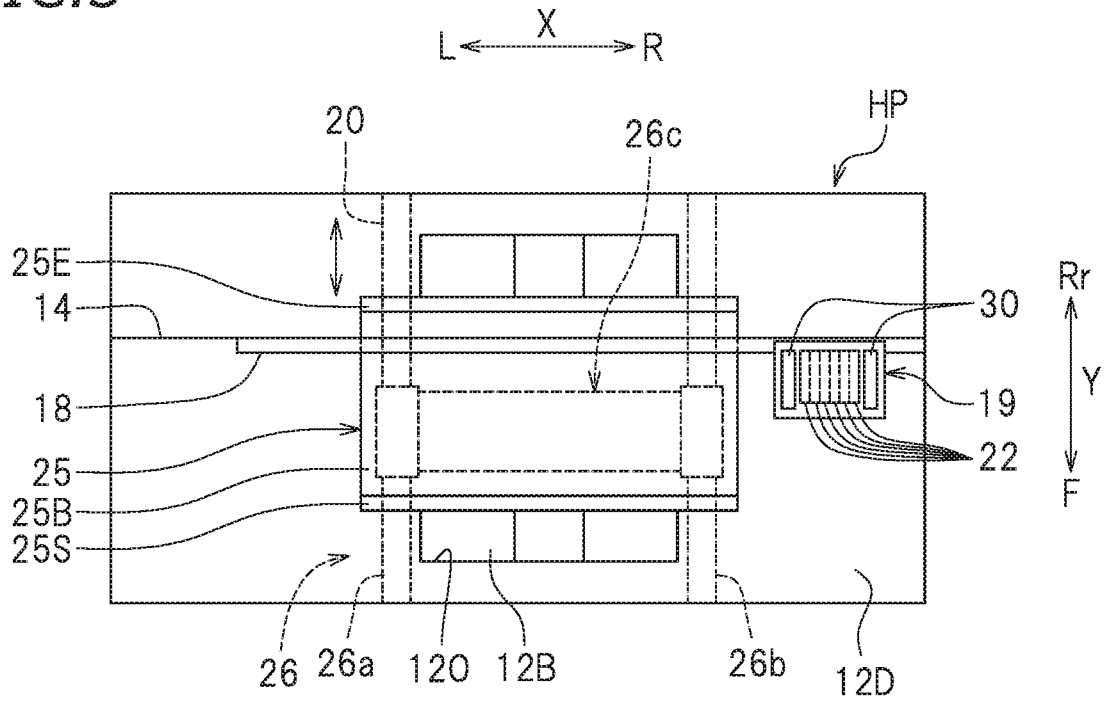
FIG. 3 is a plan view of the inside of a photo-curing inkjet printer according to a preferred embodiment of the present invention.
Figure 4:
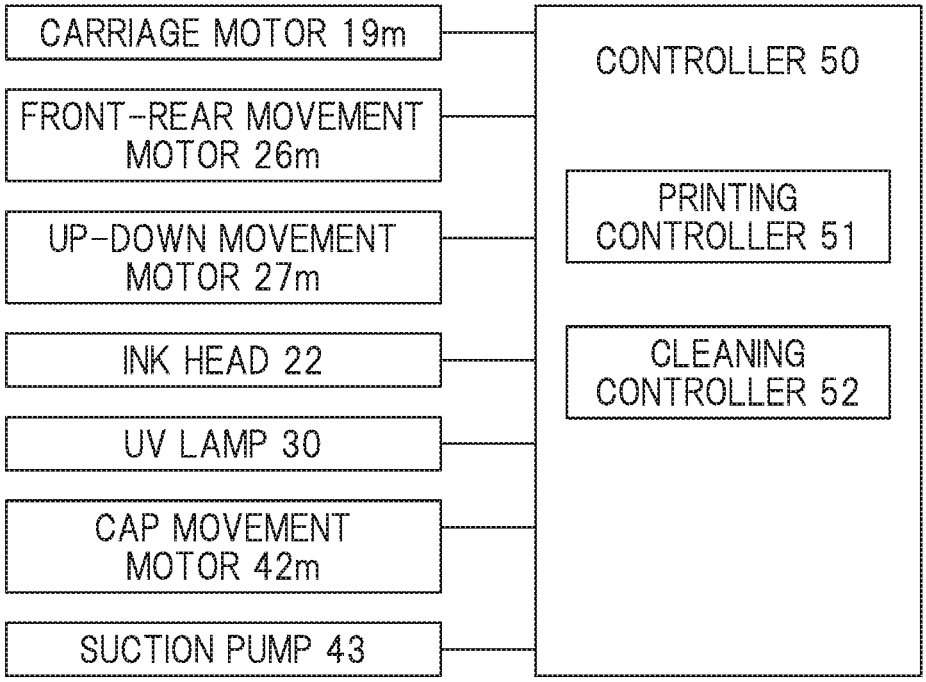
FIG. 4 is a block diagram of a photo-curing inkjet printer according to a preferred embodiment of the present invention.

FIG. 1 is a perspective view of a photo-curing inkjet printer 10 (hereinafter simply referred to as a "printer 10"). FIG. 2 is a front view of the printer 10, with its front cover 13 opened. FIG. 3 is a plan view of the inside of the printer 10. FIG. 4 is a block diagram of the printer 10. As used herein, the term "inkjet printer" refers to any of various printers that use inkjet printing methods known in the related art, such as continuous methods (e.g., a binary deflection method and a continuous deflection method) and various on-demand methods (e.g., a thermal method and a piezoelectric method).

As used herein, the terms "right", "left", "up", and "down" respectively refer to right, left, up, and down with respect to a user (i.e., the user of the printer 10) facing the front of the printer 10. The term "forward" refers to a direction away from the rear of the printer 10 and toward the user. The term "rearward" refers to a direction away from the user and toward the rear of the printer 10. The reference signs F, Rr, R, L, U, and D in the drawings respectively represent front, rear, right, left, up, and down. The reference sign X in the drawings represents a right-left direction (which may also be referred to as a "scanning direction"). The reference sign Y in the drawings represents a front-rear direction (which may also be referred to as a "conveyance direction"). The reference sign Z in the drawings represents an up-down direction. These directions are defined merely for the sake of convenience of description and do not limit in any way how the printer 10 may be installed.

As illustrated in FIG. 1, the printer 10 has a box shape. The printer 10 preferably is a "flatbed printer", for example. The printer 10 includes a casing 12 and the front cover 13. An opening 11 (see FIG. 2) is defined in the casing 12. The front cover 13 covers the opening 11. The opening 11 is openable and closable by the front cover 13. The front cover 13 is supported by the casing 12 such that the front cover 13 is rotatable around its rear end. Rotating the front cover 13 upward around its rear end brings the internal space of the casing 12 into communication with an external space.

The casing 12 includes a bottom wall 12D, a front wall 12F, a rear wall 12Rr, a left wall 12L, a right wall 12R, and an upper wall 12U. The bottom wall 12D is a plate. As illustrated in FIG. 3, an opening 120 is defined in the bottom wall 12D. A base 12B is disposed below the bottom wall 12D. The base 12B is exposed through the opening 120. In the present preferred embodiment, the surfaces of the bottom wall 12D and the base 12B are each made of sheet metal, such as aluminum sheet metal or stainless steel sheet metal. The surfaces of the bottom wall 12D and the base 12B are subjected to no surface treatment, such as a black anodizing or a coating. The surfaces of the bottom wall 12D and the base 12B each have a high reflectivity provided by sheet metal. The front wall 12F is connected to the front end of the bottom wall 12D. The front wall 12F extends upward from the front end of the bottom wall 12D. The rear wall 12Rr is connected to the rear end of the bottom wall 12D. The rear wall 12Rr extends upward from the rear end of the bottom wall 12D. The left wall 12L is connected to the left end of the bottom wall 12D. The left wall 12L extends upward from the left end of the bottom wall 12D. The rear end of the left wall 12L is connected to the left end of the rear wall 12Rr. The right wall 12R is connected to the right end of the bottom wall 12D. The right wall 12R extends upward from the right end of the bottom wall 12D. The front end of the right wall 12R is connected to the right end of the front wall 12F. The rear end of the right wall 12R is connected to the right end of the rear wall 12Rr. The upper wall 12U is connected to the upper end of the front wall 12F, the upper end of the rear wall 12Rr, the upper end of the left wall 12L, and the upper end of the right wall 12R.

As illustrated in FIG. 2, the printer 10 includes a partition 15 extending in the up-down direction Z. The partition 15 divides the internal space of the casing 12 into a first area 16 and a second area 17 located side by side in the right-left direction X. The first area 16 is a space located on the left of the partition 15. The first area 16 is a space surrounded by the bottom wall 12D, the front wall 12F, the rear wall 12Rr, the left wall 12L, the partition 15, the upper wall 12U, and the front cover 13. The first area 16 is a space where printing is effected on a substrate 25*a*. The second area 17 is a space located on the right of the partition 15. As illustrated in FIG. 1, a cleaner 40 and a controller 50 are disposed in the second area 17.

The substrate 25*a* may be a flat object or a three-dimensional object. Examples of the flat object include printing paper. Examples of the three-dimensional object include various cases (such as mobile phone cases), small electronic devices (such as electronic cigarettes), small articles (such as key rings and photo frames), daily necessities, and fashion accessories. Examples of materials for the substrate 25*a* may naturally include paper, such as plain paper and inkjet printing paper. Examples of materials for the substrate 25*a* may further include: resins, such as polyvinyl chloride, acrylic resin, polycarbonate, polystyrene, and acrylonitrile butadiene styrene (ABS) copolymer; metals, such as aluminum and stainless steel; carbon; earthenware; ceramics; glass; rubber; and leather.

The internal structure of the printer 10 will be described below. The printer 10 according to the present preferred embodiment includes a guide rail 18, a carriage 19, ink heads 22, ink cartridges 21, ultraviolet (UV) lamps 30, a table 25, a first table conveyor 26, a second table conveyor 27, the cleaner 40, and the controller 50. In FIG. 3, the front wall 12F, the rear wall 12Rr, the left wall 12L, the right wall 12R, the upper wall 12U, the front cover 13, and the partition 15 are removed, and no substrate 25*a* is illustrated.

As illustrated in FIG. 3, the casing 12 according to the present preferred embodiment is internally provided with an inner wall 14 extending in the right-left direction X. The left end of the inner wall 14 is connected to the left wall 12L. The right end of the inner wall 14 is connected to the right wall 12R. The guide rail 18 is secured to the inner wall 14. The guide rail 18 is disposed in the casing 12. The guide rail 18 extends through the first and second areas 16 and 17 in the right-left direction X. The carriage 19 is slidable along the guide rail 18. The guide rail 18 guides movement of the carriage 19 in the right-left direction X.

The carriage 19 is in slidable engagement with the guide rail 18. The carriage 19 is disposed in the casing 12. The carriage 19 is equipped with the ink heads 22 and the UV lamps 30. The number of ink heads 22 preferably is six, for example. The number of UV lamps 30 preferably is two, for example. The carriage 19 has a length L19 (see FIG. 7) in the front-rear direction Y. When the printer 10 is performing no printing operation (e.g., when the printer 10 is not operating), the carriage 19 is put on standby at a home position HP in the second area 17. The carriage 19 is reciprocated in the scanning direction (which corresponds to the right-left direction X in the present preferred embodiment) along the guide rail 18 by a carriage conveyor (not illustrated). The carriage conveyor includes first and second pulleys (not illustrated), an endless belt (not illustrated), and a carriage motor 19*m* (see FIG. 4). The first pulley is disposed on the right end of the guide rail 18. The second pulley is disposed on the left end of the guide rail 18. The carriage 19 is secured to the belt wound around the first and second pulleys. The carriage motor 19*m* is connected to one of the first and second pulleys. The carriage motor 19*m* is electrically connected to the controller 50 and thus controlled by the controller 50. Driving the carriage motor 19*m* rotates the pulley connected thereto, causing the belt to run. The carriage 19 thus moves in the right-left direction X along the guide rail 18 together with the ink heads 22 and the UV lamps 30 mounted on the carriage 19.

The ink heads 22 are mounted on the carriage 19. The ink heads 22 are disposed in the casing 12. The ink heads 22 are disposed above the table 25. The ink heads 22 discharge ink onto the substrate 25*a* placed on the table 25. Each ink head 22 is an example of a discharger. The six ink heads 22 are located side by side in the right-left direction X. The six ink heads 22 are disposed in in-line rows. The six ink heads 22 each discharge one of cyan ink (C), magenta ink (M), yellow ink (Y), black ink (K), white ink, and gloss ink.

Figure 5:
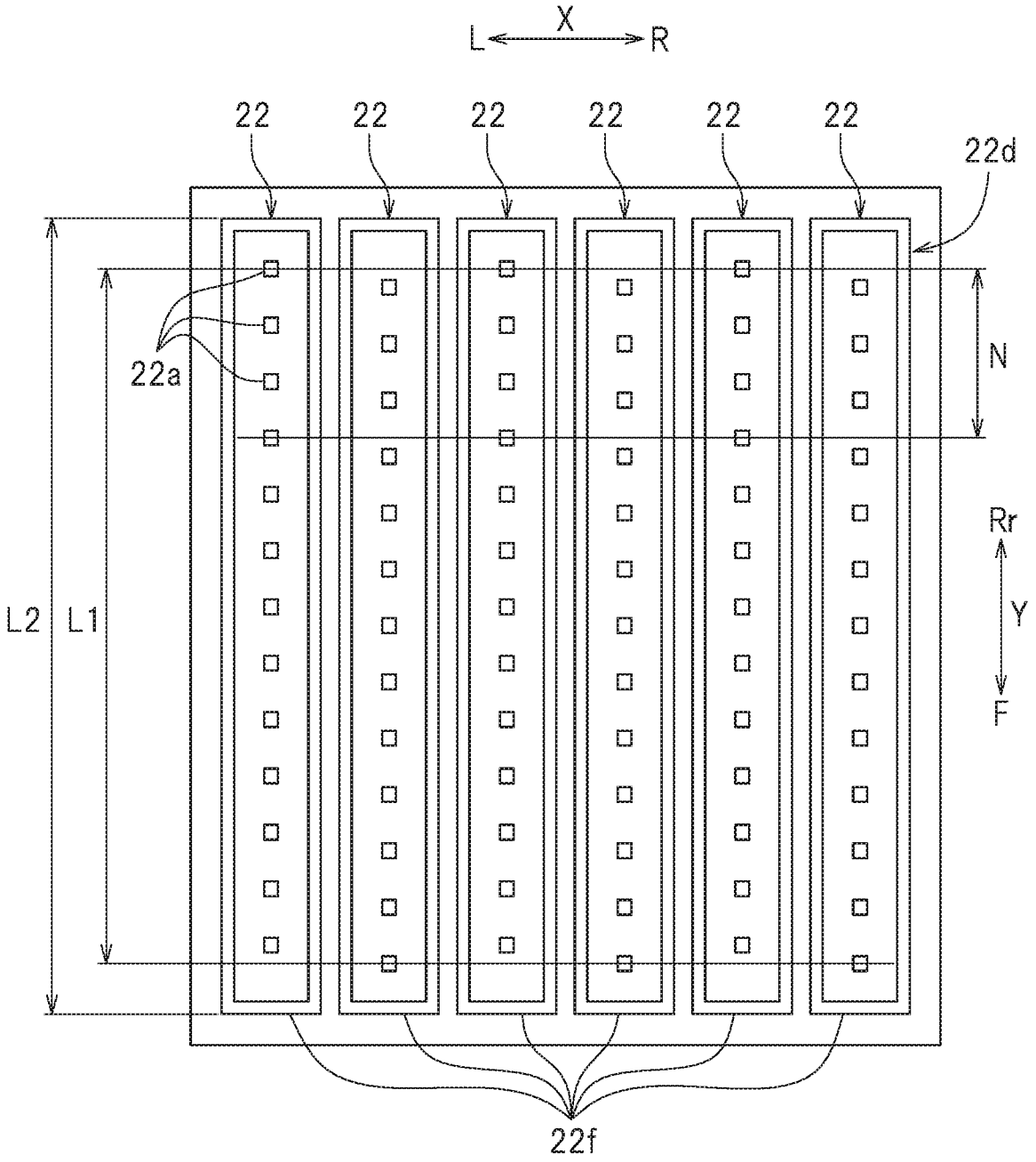
FIG. 5 is a schematic diagram illustrating the lower surfaces of ink heads according to a preferred embodiment of the present invention.

FIG. 5 is a schematic diagram illustrating the lower surfaces of the ink heads 22. The lower surface of each ink head 22 is provided with a plurality of nozzles 22*a* to discharge ink. The nozzles 22*a* each discharge ink downward. The lower surfaces of the ink heads 22 define a nozzle surface 22*d* through which the nozzles 22*a* pass. The nozzles 22*a* of each ink head 22 are arranged at regular intervals in the front-rear direction Y. In the present preferred embodiment, the nozzles 22*a* of each ink head 22 are arranged in the longitudinal direction of each ink head 22. The nozzles 22*a* of each ink head 22 are surrounded by an associated one of outer frames 22*f*. Although the number of nozzles 22*a* of each ink head 22 illustrated in FIG. 5 is 13, each ink head 22 is actually provided with a larger number of nozzles 22*a*. In one example, the number of nozzles 22*a* of each ink head 22 is 192.

The nozzles 22*a* have a nozzle row length L1 in the front-rear direction Y of the nozzle surface 22*d*. The nozzles 22*a* to be used for printing include the foremost nozzles 22*a* in the front-rear direction Y and the rearmost nozzles 22*a* in the front-rear direction Y. The nozzle row length L1 is measured between the centers of the foremost and rearmost nozzles 22*a* of the ink heads 22. The nozzle row length L1 may be equal to or shorter than the length L19 of the carriage 19. The nozzle row length L1 is divided into maximum pass widths N in the front-rear direction Y. Each maximum pass width N is a pass width for a single pass for printing effected by the printer 10 using the smallest number of passes. In other words, the maximum pass width N is the width of a single pass row for printing effected by the printer 10 using the smallest number of passes. N satisfies, for example, the following expression: $N \leq (L1)/4$. In the present preferred embodiment, the smallest number of passes for printing effected by the printer 10 is four, and the maximum pass width N is the width of a pass row for one of the four passes, for example. This means that $N=(L1)/4$, for example. The nozzle surface 22*d* has a length L2 in the front-rear direction Y. The length L2 of the nozzle surface 22*d* corresponds to the length of each outer frame 22*f* in the front-rear direction Y. The length L2 of the nozzle surface 22*d* may be equal to or shorter than the length L19 of the carriage 19. The ink heads 22 are electrically connected to the controller 50. The controller 50 controls discharge of ink from the nozzles 22*a*.

Each ink head 22 is in communication with an associated one of the ink cartridges 21 through a flexible ink tube (not illustrated). The number of ink cartridges 21 is equal to the number of ink heads 22. In the present preferred embodiment, the number of ink cartridges 21 preferably is six, for example. An ink cartridge fitting portion 20 is provided on the left rear portion of the casing 12. The ink cartridges 21 are fitted to the ink cartridge fitting portion 20. The ink cartridges 21 each store photo-curable ink. The photo-curable ink is cured upon being irradiated with light. The photo-curable ink used in the present preferred embodiment is ultraviolet-curable ink (hereinafter referred to as "UV ink") that is cured upon being irradiated with ultraviolet light preferably having a wavelength of about 10 nm to about 400 nm, for example. The photo-curable ink typically contains a polymerizable compound and a polymerization initiator. When necessary, the photo-curable ink may contain various other additives. Examples of the additives include a coloring agent (such as a pigment), a photosensitizer, a polymerization inhibitor, an ultraviolet light absorber, an antioxidant, a plasticizer, a surfactant, a leveling agent, a thickener, a dispersant, an antifoaming agent, an antiseptic, and a solvent.

In the present preferred embodiment, the UV lamps 30 and the ink heads 22 are mounted on the carriage 19. The UV lamps 30 are disposed in the casing 12. The UV lamps 30 are disposed above the table 25. The UV lamps 30 apply ultraviolet light to the UV ink discharged onto the substrate 25*a* from the ink heads 22. The UV lamps 30 each emit light of a wavelength that cures the UV ink. Each UV lamp 30 is an example of a light applicator. One of the UV lamps 30 is disposed rightward of the ink heads 22, and the other UV lamp 30 is disposed leftward of the ink heads 22. This enables application of ultraviolet light to the UV ink discharged onto the substrate 25*a*, irrespective of whether the carriage 19 moves rightward or leftward in the right-left direction X. Consequently, the present preferred embodiment enables bidirectional printing.

Figure 7:
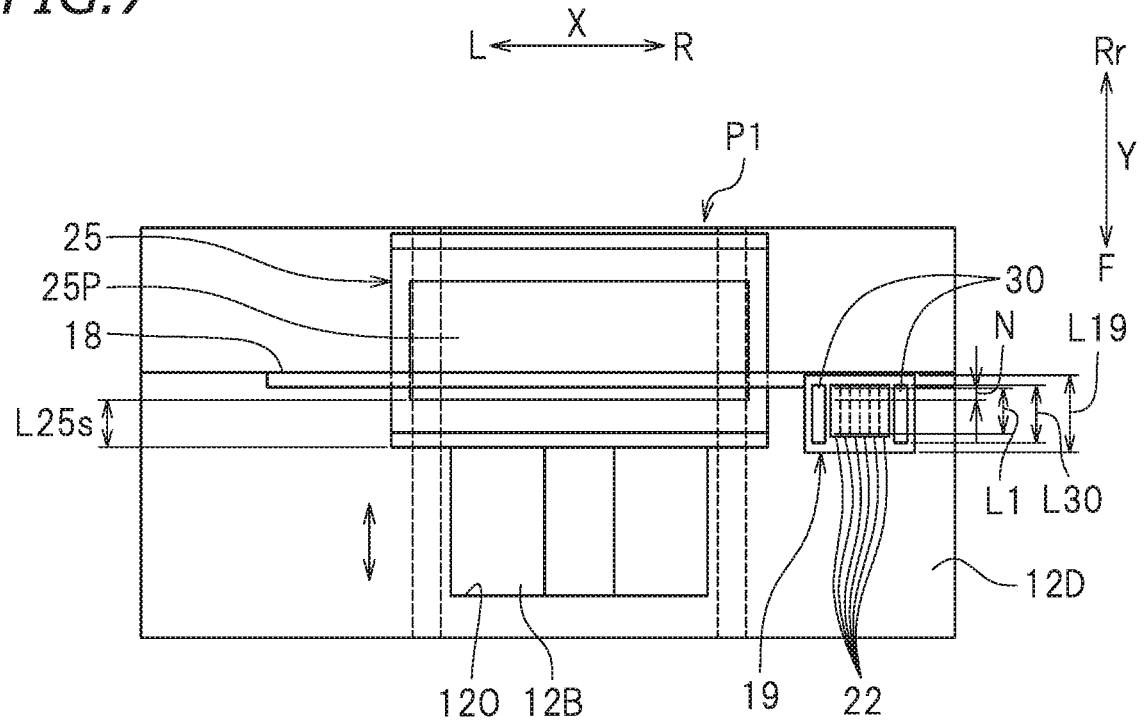
FIG. 7 is a plan view of the inside of the photo-curing inkjet printer in the initial stage of printing.

Each UV lamp 30 has a length L30 (see FIG. 7). When each UV lamp 30 includes a single light source, the length L30 of each UV lamp 30 is measured between a first end of the light source and a second end of the light source in the front-rear direction Y. Each UV lamp 30 may include a row of light sources arranged in the front-rear direction Y. The light sources are, for example, light-emitting diode (LED) devices. In this case, the length L30 of each UV lamp 30 is a length of the row of light sources measured between the center of the foremost one of the LED devices and the center of the rearmost one of the LED devices in the front-rear direction Y. The length L30 of each UV lamp 30 may be equal to or longer than the nozzle row length L1 of the nozzles 22*a* of the ink heads 22. In the present preferred embodiment, the length L30 of each UV lamp 30 is longer than the nozzle row length L1 of the nozzles 22*a* of the ink heads 22. The rear end of each UV lamp 30 and the rear end of each ink head 22 are located on the same imaginary line perpendicular to the front-rear direction Y. The front end of each UV lamp 30 is located forward of the front end of each ink head 22. The UV lamps 30 are thus able to efficiently apply ultraviolet light to the UV ink (which has been discharged from the ink heads 22) so as to cure the UV ink. The length L30 of each UV lamp 30 may be equal to or longer than the length L2 of the nozzle surface 22*d* of the ink heads 22. The length L30 of each UV lamp 30 may be equal to or shorter than the length L19 of the carriage 19.

The table 25 is disposed in the casing 12. Specifically, the table 25 is disposed in the first area 16. The table 25 is disposed below the carriage 19, the ink heads 22, and the UV lamps 30. The table 25 is disposed above the bottom wall 12D. The length of the table 25 measured in the front-rear direction Y is shorter than the length of a portion of the bottom wall 12D located in the first area 16. In the present preferred embodiment, the upper surface of the table 25 is smaller in area (on an XY plane) than the upper surface of the portion of the bottom wall 12D located in the first area 16. The table 25 is an example of a bed on which the substrate 25*a* is to be placed.

Figure 6A:
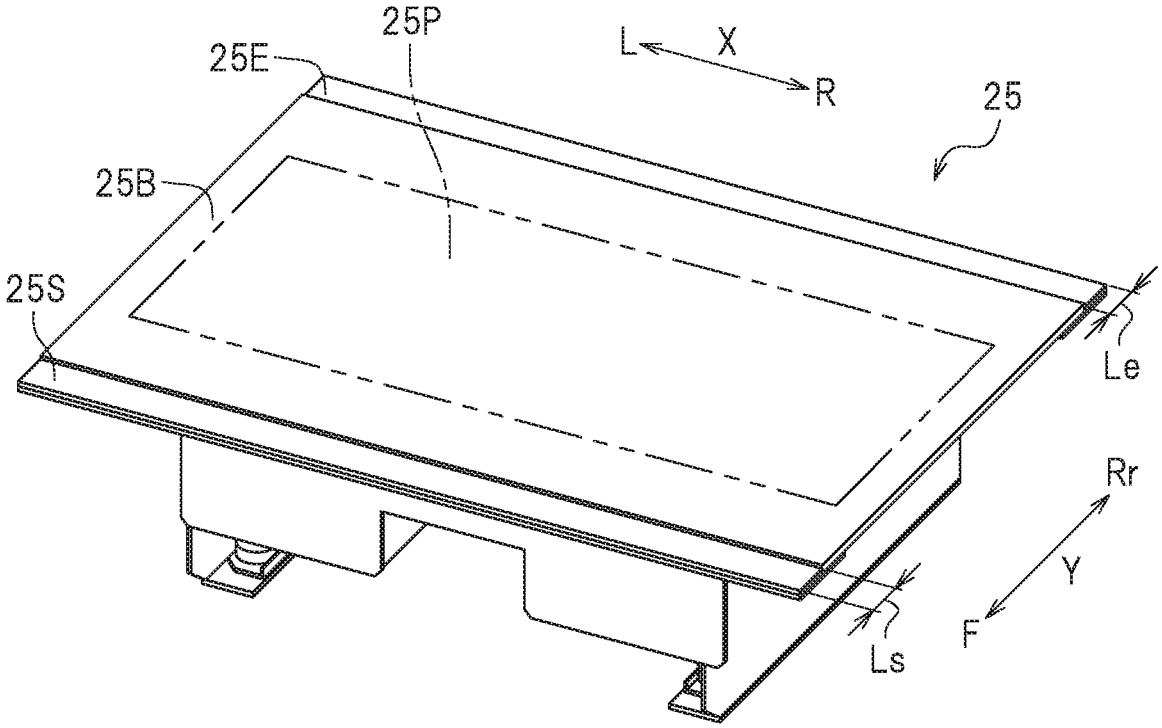
FIG. 6A is a perspective view of a table according to a preferred embodiment of the present invention.

FIG. 6A is a perspective view of the table 25. The table 25 includes a body 25B, a start end member 25S, and a finish end member 25E. The start end member 25S and the finish end member 25E are attached to the body 25B. The body 25B includes a rectangular upper surface. The upper surface of the body 25B is flat. The surface of the body 25B is made of sheet metal, such as aluminum sheet metal or stainless steel sheet metal. Similarly to, for example, the bottom wall 12D of the casing 12, the surface of the body 25B has a high reflectivity provided by sheet metal. A printable region 25P is defined on the upper surface of the body 25B. The printable region 25P is a region where an image is printable by the ink heads 22. In other words, the printable region 25P is a region onto which the ink heads 22 are able to discharge ink. Printing is effected on the printable region 25P from its start end to its finish end. The printable region 25P is uniquely defined for the printer 10. In other words, the printable region 25P is unique to the printer 10. At least a portion of the substrate 25*a* is placed on the printable region 25P. In the present preferred embodiment, the printable region 25P is equal or substantially equal in area to the substrate 25*a* in a plan view. The printable region 25P may also be used for positioning of the substrate 25*a* to be placed on the table 25.

The start end member 25S extends forward from the body 25B. The upper surface of the start end member 25S is flush with the upper surface of the body 25B. The start end member 25S is located on the downstream side in the conveyance direction (i.e., the front-rear direction Y) at the start of printing. In other words, the start end member 25S (which is one of the two ends of the table 25 in the front-rear direction Y) is located relatively close to the ink heads 22 at the start of printing. The start end member 25S prevents reflected light (which is reflected by the bottom wall 12D and/or the base 12B) from being incident on the nozzles 22*a* mainly in the initial stage of printing (e.g., when printing is effected on the start end of the printable region 25P). The substrate 25*a* is not placed on the start end member 25S. The start end member 25S has a length Ls in the front-rear direction Y. In the present preferred embodiment, the length Ls is set such that the start end member 25S will not come into contact with the front cover 13. The length Ls of the start end member 25S is typically shorter than the length of the body 25B measured in the front-rear direction Y. The length Ls of the start end member 25S may be between about 5 mm and about 40 mm inclusive, for example. The length Ls of the start end member 25S is, for example, between about 10 mm and about 30 mm inclusive.

The finish end member 25E extends rearward from the body 25B. The upper surface of the finish end member 25E is flush with the upper surface of the body 25B. The finish end member 25E is located on the upstream side in the conveyance direction (i.e., the front-rear direction Y) at the start of printing. In other words, the finish end member 25E (which is the other one of the two ends of the table 25 in the front-rear direction Y) is located away from the ink heads 22 at the start of printing. The finish end member 25E prevents reflected light (which is reflected by the bottom wall 12D and/or the base 12B) from being incident on the nozzles 22*a* mainly in the final stage of printing (e.g., when printing is effected on the finish end of the printable region 25P). The substrate 25*a* is not placed on the finish end member 25E. The finish end member 25E has a length Le in the front-rear direction Y. In the present preferred embodiment, the length Le is set such that the finish end member 25E will not come into contact with the rear wall 12Rr. The length Le of the finish end member 25E may be equal to or different from the length Ls of the start end member 25S. The length Le of the finish end member 25E is typically shorter than the length of the body 25B measured in the front-rear direction Y. The length Le of the finish end member 25E may be between about 5 mm and about 40 mm inclusive, for example. The length Le of the finish end member 25E may be, for example, between about 10 mm and about 30 mm inclusive.

Figure 6B:
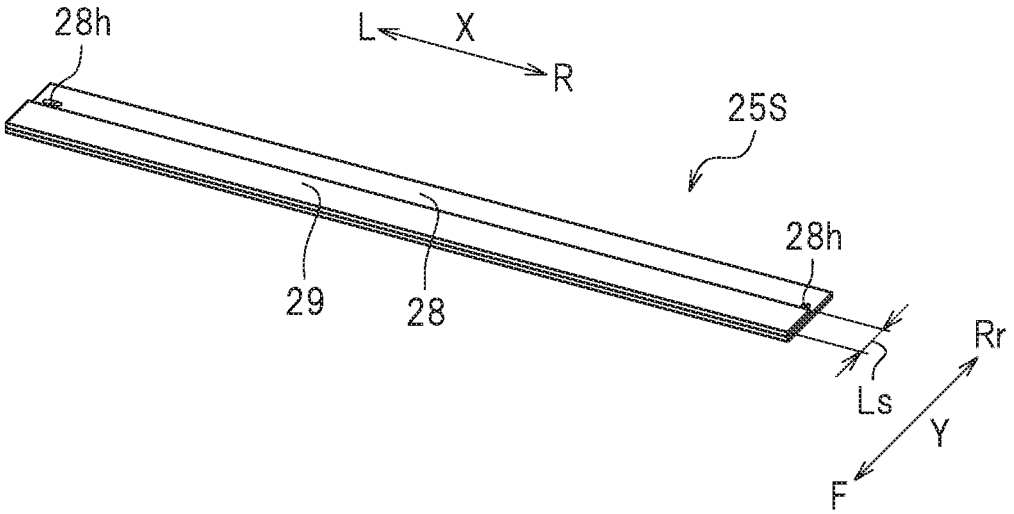
FIG. 6B is a perspective view of a start end member of the table removed from a body of the table.

FIG. 6B is a perspective view of the start end member 25S. The start end member 25S includes a shield 29 and a support 28 supporting the shield 29. The support 28 is preferably able to stably support the shield 29. The support 28 is made of, for example, synthetic resin, such as polyvinyl chloride or acrylic resin. The support 28 may be made of, for example, metal, such as aluminum or stainless steel. The support 28 may be made of, for example, the same material as the body 25B. The thickness of the support 28 may be between about 0.1 mm and about 10 mm inclusive, for example. The thickness of the support 28 may be, for example, between about 1 mm and about 5 mm inclusive. As used herein, the term "thickness of the support 28" refers to the length of the support 28 measured in the up-down direction Z. The ends of the support 28 in the right-left direction X are each provided with a positioning hole 28*h*. The body 25B includes, for example, protrusions (not illustrated). With the protrusions of the body 25B fitted into the holes 28*h*, the support 28 of the start end member 25S is attached to the underside (or lower surface) of the front end of the body 25B with a binder, such as a double-sided adhesive tape. Alternatively, the start end member 25S may be attached to the body 25B by, for example, inserting fixtures into the holes 28*h*.

The shield 29 is bonded to the support 28 and physically integral with the support 28. The shield 29 defines the surface of the start end member 25S. The shield 29 is made of, for example, a material having a relatively higher light-shielding property than the body 25B and/or the support 28. The shield 29 is made of, for example, a material having a higher light-absorbing property than the bottom wall 12D and/or the base 12B. The shield 29 is an example of a reflected light protection member. From the viewpoint of enhancing the property of absorbing reflected light, the shield 29 may be made of an opaque material, such as a black material. From the viewpoint of enhancing the property of diffusing reflected light, the surface of the shield 29 may be provided with projections and depressions. The shield 29 may be, for example, a foam or a velvety sheet. Specific examples of the foam include a porous material made of ethylene propylene diene monomer (EPDM) rubber. Commercially available examples of the foam include an OPSEALER® sponge and an EPTSEALER® sponge. The thickness of the shield 29 may be smaller than, for example, the thickness of the body 25B. The thickness of the shield 29 may be between about 0.1 mm and about 10 mm inclusive, for example. The thickness of the shield 29 may be, for example, between about 1 mm and about 5 mm inclusive. The length of the shield 29 measured in the front-rear direction Y is equal to the length Ls of the start end member 25S. Although not illustrated in detail, the finish end member 25E is identical in structure to the start end member 25S in the present preferred embodiment.

The table 25 is movable in the front-rear direction Y by the first table conveyor 26. The first table conveyor 26 moves the table 25 relative to the ink heads 22 in the front-rear direction Y. The first table conveyor 26 moves the table 25 during printing such that the start end and finish end of the printable region 25P move relative to the ink heads 22. As illustrated in FIG. 3, the first table conveyor 26 is disposed under the opening 120 defined in the bottom wall 12D of the casing 12. The first table conveyor 26 includes two slide rails 26*a* and 26*b*, a conveyor 26*c*, and a front-rear movement motor 26*m* (see FIG. 4). The slide rails 26*a* and 26*b* extend in the front-rear direction Y. The slide rails 26*a* and 26*b* are supported by the bottom wall 12D. The slide rails 26*a* and 26*b* are parallel or substantially parallel to each other. The conveyor 26*c* is slidable along the slide rails 26*a* and 26*b*. The table 25 is supported above the conveyor 26*c* by a member other than the conveyor 26*c*. The front-rear movement motor 26*m* is electrically connected to the controller 50 and thus controlled by the controller 50. Driving the front-rear movement motor 26*m* moves the conveyor 26*c* along the slide rails 26*a* and 26*b*. This moves the table 25 in the front-rear direction Y. The first table conveyor 26 is an example of a conveyor to move the table 25 relative to the ink heads 22 in the conveyance direction.

The table 25 is movable in the up-down direction Z by the second table conveyor 27. The second table conveyor 27 is connected to the first table conveyor 26 under the opening 120 defined in the bottom wall 12D. The second table conveyor 27 extends through the opening 120 so as to support the table 25. The second table conveyor 27 includes a height adjuster 27*a* and an up-down movement motor 27*m* (see FIG. 4). The height adjuster 27*a* is provided on the lower surface of the table 25. The height adjuster 27*a* is connected to the up-down movement motor 27*m*. The up-down movement motor 27*m* is electrically connected to the controller 50 and thus controlled by the controller 50. Driving the up-down movement motor 27*m* changes the height of the height adjuster 27*a*. This adjusts the position of the table 25 in the up-down direction Z (i.e., the height of the table 25).

Figure 9:
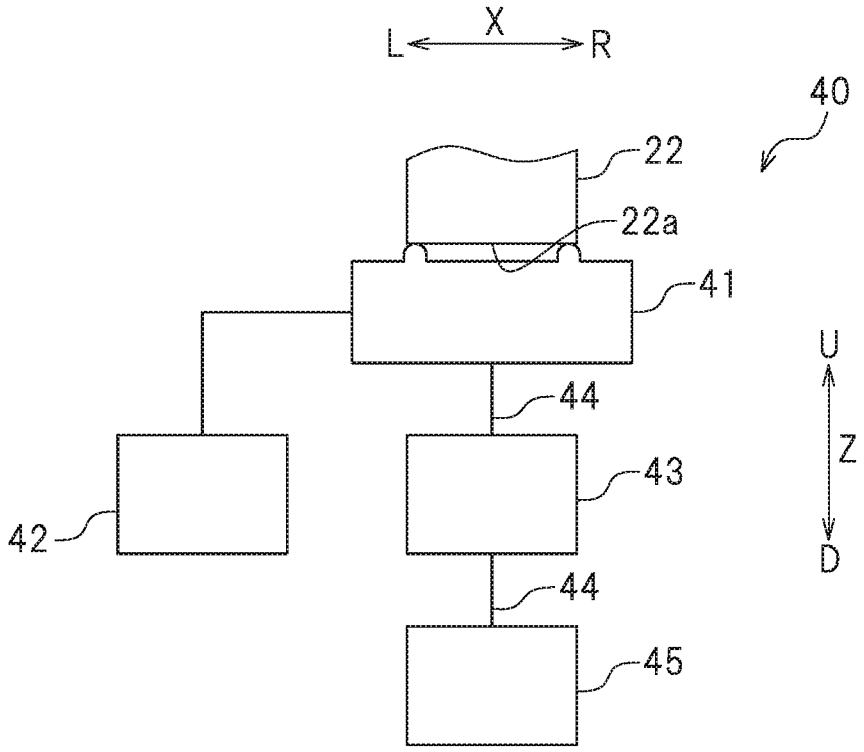
FIG. 9 is a schematic diagram illustrating a cleaner according to a preferred embodiment of the present invention.

FIG. 9 is a schematic diagram illustrating the cleaner 40. The cleaner 40 removes, for example, cured ink adhering to the nozzle surface 22*d* of the ink heads 22. The cleaner 40 at the home position HP is located below the carriage 19. The cleaner 40 includes caps 41, a cap mover 42, suction pumps 43, waste ink passages 44, and a waste ink receiver 45. The caps 41 cover the nozzles 22*a* of the lower surfaces of the ink heads 22. Covering the nozzles 22*a* with the caps 41 defines an enclosed space between each cap 41 and the nozzles 22*a* of the associated ink head 22. The number of caps 41 is typically equal to the number of ink heads 22. In the present preferred embodiment, the number of caps 41 is six, for example. The cap mover 42 supports the caps 41 and moves the caps 41 in the up-down direction Z. The cap mover includes a cap movement motor 42*m* (see FIG. 4). The cap movement motor 42*m* is electrically connected to the controller 50 and thus controlled by the controller 50. The caps 41 are thus movable between a capping position at which the nozzles 22*a* are covered by the caps 41 and an uncapping position at which the nozzles 22*a* are uncovered by the caps 41. The cap 41 illustrated in FIG. 9 is located at the capping position. In other words, the cap 41 illustrated in FIG. 9 is fitted to the associated ink head 22.

The suction pumps 43 suck ink inside the nozzles 22*a*. The suction pumps 43 are electrically connected to the controller 50 and thus controlled by the controller 50. Each suction pump 43 is disposed at a location somewhere along the associated waste ink passage 44. Through the waste ink passages 44, waste ink flows from the caps 41 to the waste ink receiver 45. Each waste ink passage 44 is, for example, a flexible ink tube. The number of waste ink passages 44 is typically equal to the number of ink heads 22. In the present preferred embodiment, the number of waste ink passages 44 is six, for example. With the nozzles 22*a* of the ink heads 22 covered with the caps 41, driving the suction pumps 43 sucks the ink inside the nozzles 22*a* through the caps 41. Waste ink that will not be used for printing (e.g., ink remaining in the nozzles 22*a*) is thus discharged into the caps 41. With the nozzles 22*a* of the ink heads 22 covered with the caps 41, driving the ink heads 22 discharges the ink (which remains in the nozzles 22*a*) into the caps 41. The waste ink is thus discharged into the caps 41. The waste ink discharged into the caps 41 is delivered to the waste ink receiver 45 through the waste ink passages 44.

The controller 50 controls operations of the components of the printer 10. The controller 50 is typically a computer. In one example, the controller 50 includes an interface (I/F), a central processing unit (CPU), a read-only memory (ROM), a random-access memory (RAM), and a storage (such as a memory). The I/F receives print data. The CPU executes a command included in a control program. The ROM stores the program to be executed by the CPU. The RAM is used as a working area where the program is to be expanded. The storage stores the program and various data.

As illustrated in FIG. 4, the controller 50 includes a printing controller 51 and a cleaning controller 52. The functions of the controller 50 may be implemented by software or hardware. The functions of the controller 50 may be performed by processor(s) or may be incorporated into circuit(s).

The printing controller 51 controls printing operations. The printing controller 51 is communicably connected to the carriage motor 19*m* of the carriage conveyor, the front-rear movement motor 26*m* of the first table conveyor 26, and the up-down movement motor 27*m* of the second table conveyor 27. The printing controller 51 thus controls the relative positions of the ink heads 22 and the table 25. The printing controller 51 is communicably connected to the ink heads 22 so as to control the timing for discharging ink. The printing controller 51 is communicably connected to the UV lamps 30 so as to control the timing for applying ultraviolet light. The printing controller 51 causes the ink heads 22 to discharge ink from the nozzles 22*a* such that the ink adheres to the substrate 25*a*, while moving the carriage 19 in the right-left direction X. The printing controller 51 then causes the UV lamps 30 to apply ultraviolet light to the UV ink on the substrate 25*a* so as to cure the ink. The printing controller 51 thus effects printing on the substrate 25*a*.

The printing controller 51 effects multi-pass printing. If UV ink is discharged from all the nozzles 22*a* of the ink heads 22 at a time (i.e., if single-pass printing is effected), some of the UV ink will be uncured on the substrate 25*a*, making it likely that the ink will spread or run on the substrate 25*a*. To cope with such a problem, the printing controller 51 performs a plurality of separate operations each involving causing the ink heads 22 to discharge the UV ink from some of the nozzles 22*a* while moving the carriage 19 in the right-left direction X. The printing controller 51 starts the first pass, with the ink heads 22 located over the printable region 25P by a single pass width (i.e., the maximum pass width N). For example, when the smallest number of passes is four, the printing controller 51 performs a total of four separate operations each involving causing the ink heads 22 to discharge the UV ink from the nozzles 22*a* within the maximum pass width N while moving the carriage 19 in the right-left direction X. This prevents the ink from spreading or running on the substrate 25*a*.

FIG. 7 is a plan view of the inside of the printer 10 in the initial stage of printing. In FIG. 7, the table 25 is located at a printing start position P1. At the printing start position P1, the rear end of the table 25 is located at a rearmost position within a movable range in the front-rear direction Y. In the present preferred embodiment, the table 25 includes the start end member 25S attached to the body 25B. A length L25*s* of the table 25 measured from its start end to the start end of the printable region 25P is thus equal to or longer than a length (L1−N) in the front-rear direction Y. The length (L1−N) is calculated by subtracting the maximum pass width N from the nozzle row length L1 of the nozzles 22*a* of the ink heads 22. In other words, the length L25*s* satisfies the following expression: (L1−N)≤L25*s*. A portion of the upper surface of the table 25 extending from its start end to the start end of the printable region 25P is located outside the printable region 25P (on which the substrate 25*a* is to be placed) and forward of the printable region 25P. The reflected light reflected by the bottom wall 12D and/or the base 12B will thus be unlikely to reach the nozzles 22*a* in the initial stage of printing (e.g., immediately after the start of printing). This reduces the amount of reflected light incident on the nozzles 22*a* during printing.

The length L25*s* of the table 25 measured from its start end to the start end of the printable region 25P may be equal to or longer than the nozzle row length L1 of the nozzles 22*a* of the ink heads 22. The length L25*s* may satisfy the following expression: L1≤L25*s*. The length L25*s* of the table 25 measured from its start end to the start end of the printable region 25P may be longer than the length L2 of the nozzle surface 22*d* of the ink heads 22. The reflected light is thus unlikely to reach not only the nozzles 22*a* but also areas adjacent to the nozzles 22*a*. This more reliably reduces the occurrence of discharge failure. The length L25*s* of the table 25 measured from its start end to the start end of the printable region 25P may be equal to or longer than the length L30 of each UV lamp 30. When a gap between each UV lamp 30 and the table 25 is large, the light applied from each UV lamp 30 may be reflected in a complicated manner and may strike the ink heads 22. Making the length L25*s* equal to or longer than the length L30, however, makes it unlikely that the light applied from the UV lamps 30 will reach the bottom wall 12D and/or the base 12B and thus reduces the amount of reflected light reflected by the bottom wall 12D and/or the base 12B. Alternatively, the length L25*s* of the table 25 measured from its start end to the start end of the printable region 25P may be equal to or shorter than the length L30 of each UV lamp 30. The length L25*s* of the table 25 measured from its start end to the start end of the printable region 25P may be equal to or shorter than the length L19 of the carriage 19 measured in the front-rear direction Y. In such cases, the printer 10 will be compact in size, making it possible to increase the area of the printable region 25P on the table 25.

Figure 8:
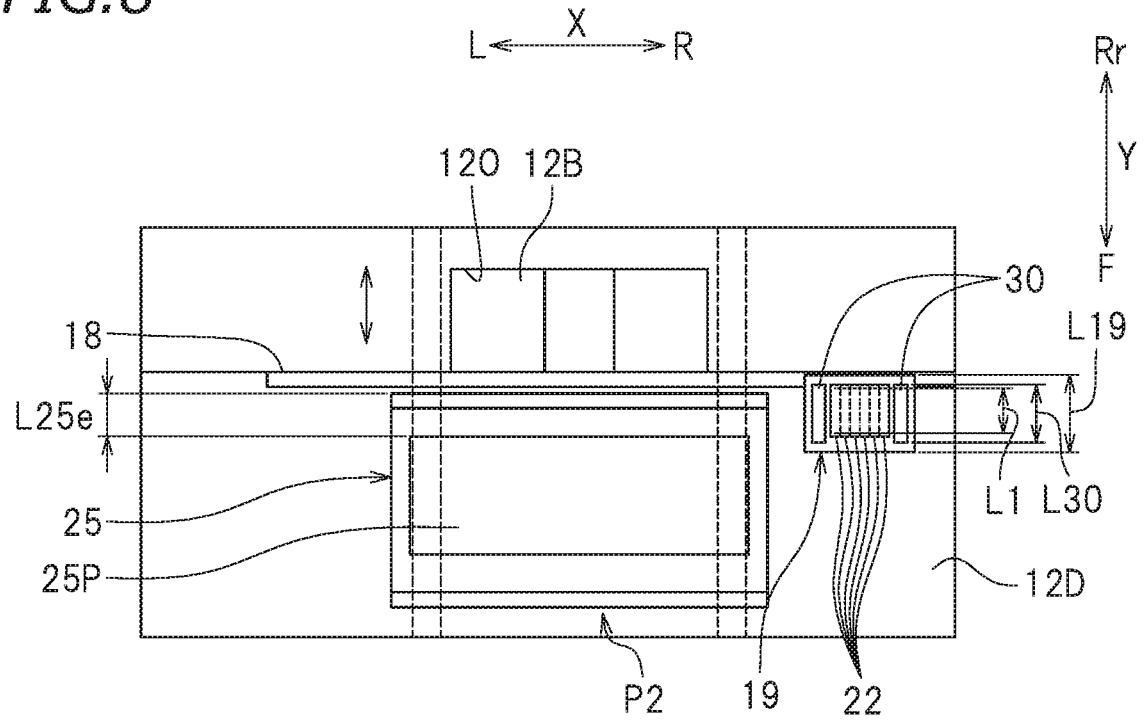
FIG. 8 is a plan view of the inside of the photo-curing inkjet printer in the final stage of printing.

FIG. 8 is a plan view of the inside of the printer 10 in the final stage of printing. In FIG. 8, the table 25 is located at a printing finish position P2. At the printing finish position P2, the front end of the table 25 is located at a foremost position within the movable range in the front-rear direction Y. In the present preferred embodiment, the table 25 includes the finish end member 25E attached to the body 25B. A length L25*e* of the table 25 measured from its finish end to the finish end of the printable region 25P is thus equal to or longer than the nozzle row length L1 of the nozzles 22*a* of the ink heads 22. In other words, the length L25*e* satisfies the following expression: L1 L25*e*. A portion of the upper surface of the table 25 extending from its finish end to the finish end of the printable region 25P is located outside the printable region 25P (on which the substrate 25*a* is to be placed) and rearward of the printable region 25P. Thus, if, for example, the size of an image to be printed is large and printing is effected up to an area adjacent to the finish end of the printable region 25P, the reflected light reflected by the bottom wall 12D and/or the base 12B would be unlikely to reach the nozzles 22*a*. This reduces the amount of reflected light incident on the nozzles 22*a* during printing.

The length L25*e* of the table 25 measured from its finish end to the finish end of the printable region 25P may be longer than the length L2 of the nozzle surface 22*d* of the ink heads 22. The reflected light is thus unlikely to reach not only the nozzles 22*a* but also areas adjacent to the nozzles 22*a*. This more reliably reduces the occurrence of discharge failure. The length L25*e* of the table 25 measured from its finish end to the finish end of the printable region 25P may be equal to or longer than the length L30 of each UV lamp 30 for the same reasons as those mentioned above concerning the length L25*s*. Alternatively, the length L25*e* of the table 25 measured from its finish end to the finish end of the printable region 25P may be equal to or shorter than the length L30 of each UV lamp 30. The length L25*e* of the table 25 measured from its finish end to the finish end of the printable region 25P may be equal to or shorter than the length L19 of the carriage 19 measured in the front-rear direction Y.

The cleaning controller 52 controls a cleaning operation. The cleaning controller 52 is communicably connected to the cap movement motor 42*m* so as to control the relative positions of the ink heads 22 and the caps 41. The cleaning controller 52 is communicably connected to the suction pumps 43 so as to control the timing for sucking ink inside the nozzles 22*a*. The cleaning controller 52 may automatically perform the cleaning operation each time a predetermined period of time has elapsed, for example, after execution of the previous cleaning operation. The predetermined period of time is stored in advance in the cleaning controller 52. The cleaning controller 52 may automatically perform the cleaning operation, for example, each time the printing controller 51 is operated for a predetermined period of time. The cleaning controller 52 may perform the cleaning operation that is, for example, an initial operation to be performed when the power of the printer 10 is turned on.

As described above, the printer 10 according to the present preferred embodiment is configured such that if the light applied from the UV lamps 30 is reflected by the bottom wall 12D and/or the base 12B of the casing 12 in the initial stage of printing, the reflected light would be blocked by the table 25 and would be unlikely to reach the nozzles 22*a* of the ink heads 22. This reduces the amount of reflected light incident on the nozzles 22*a*. Thus, repeating printing operations is unlikely to clog the nozzles 22*a*, enabling the ink heads 22 to stably discharge ink. The printer 10 is configured such that a time interval between the cleaning operations to be performed by the cleaning controller 52 may be set longer than before. This reduces the frequency of cleaning for the ink heads 22 so as to reduce the time required for cleaning and cut down ink consumption.

In the present preferred embodiment, the printer 10 includes the first table conveyor 26 to move the table 25 relative to the ink heads 22 in the front-rear direction Y. When the table 25 moves in the front-rear direction Y, the length of the bottom wall 12D may be about one and a half times or more than one and a half times as large as the length of the table 25. The length of the bottom wall 12D may be, for example, about twice or more as large as the length of the table 25. The light applied from the UV lamps 30 thus tends to be reflected by the bottom wall 12D and/or the base 12B of the casing 12, resulting in an increase in the amount of light incident on the nozzles 22*a*. Accordingly, the use of the techniques disclosed herein is highly effective in solving this problem.

In the present preferred embodiment, the table 25 is smaller in area than the bottom wall 12D and/or the base 12B. The light applied from the UV lamps 30 thus tends to be reflected by the bottom wall 12D and/or the base 12B of the casing 12, resulting in an increase in the amount of light incident on the nozzles 22*a*. Accordingly, the use of the techniques disclosed herein is highly effective in solving this problem. The present preferred embodiment involves closing the front cover 13 during printing so as to prevent foreign matter, such as dust in the air, from entering the first area 16.

In the present preferred embodiment, the length L25*e* of the table 25 measured from its finish end to the finish end of the printable region 25P is longer than the nozzle row length L1 of the nozzles 22*a* of the ink heads 22 in the front-rear direction Y. Thus, if printing is effected, for example, up to an area adjacent to the finish end of the printable region 25P, the present preferred embodiment would reduce the amount of reflected light incident on the nozzles 22*a*.

In the present preferred embodiment, the shield 29 to reduce reflected light incident on the ink heads 22 is disposed between the start end of the table 25 and the start end of the printable region 25P. The light applied from the UV lamps 30 is thus unlikely to reach the bottom wall 12D and/or the base 12B, resulting in a reduction in the amount of reflected light reflected by the bottom wall 12D and/or the base 12B. Consequently, the present preferred embodiment more effectively reduces the amount of reflected light incident on the nozzles 22*a*.

In the present preferred embodiment, the table 25 includes the body 25B on which the printable region 25P is defined, and the start end member 25S attached to the start end of the body 25B in the front-rear direction Y. This makes it possible to freely select a material for the start end member 25S irrespective of the material of the body 25B. The start end member 25S may be made of, for example, a material having a higher light protection capability than the material of the body 25B. The techniques disclosed herein may be used for not only the printer 10 but also various other printers.

In the present preferred embodiment, the length L25*s* of the table 25 measured from its start end to the start end of the printable region 25P is longer than the length L2 of the nozzle surface 22*d* of the ink heads 22 in the front-rear direction Y. This reduces not only the amount of reflected light incident on the nozzles 22*a* but also the amount of reflected light incident on areas adjacent to the nozzles 22*a*. Consequently, the present preferred embodiment more advantageously achieves the effects of the techniques disclosed herein.

In the present preferred embodiment, the length L25*s* of the table 25 measured from its start end to the start end of the printable region 25P is equal to or shorter than the length L30 of each UV lamp 30 in the front-rear direction Y. This increases the area of the printable region 25P on the table 25.

In the present preferred embodiment, the printer 10 includes the guide rail 18 and the carriage 19. The guide rail 18 is disposed above the table 25. The guide rail 18 extends in the right-left direction X perpendicular or substantially perpendicular to the front-rear direction Y. The carriage 19 is slidable along the guide rail 18. The carriage 19 is equipped with the ink heads 22 and the UV lamps 30. In the present preferred embodiment, the ink heads 22 are always located close to the UV lamps 30. The amount of reflected light incident on the nozzles 22*a* thus tends to increase. Accordingly, the use of the techniques disclosed herein is highly effective in solving this problem.

Although the printer 10 according to the present preferred embodiment has been described thus far, the photo-curing inkjet printers according to preferred embodiments of the present invention is not limited to the printer 10. The present invention may be practiced based on the disclosure of this specification and technical common knowledge in the related field. The techniques described in the claims include various changes and modifications made to the preferred embodiments illustrated above. Any or some of the technical features of the foregoing preferred embodiments may be replaced with any or some of the technical features of variations described below. Any or some of the technical features of the variations described below may be added to the technical features of the foregoing preferred embodiments. Any or some of the technical features of the foregoing preferred embodiments may be appropriately combined with any or some of the technical features of the variations described below. Unless described as being essential, some of the technical features of the foregoing preferred embodiments and the variations thereof described below may be optional.

In the foregoing preferred embodiments, the sheet metal is exposed on the surface(s) of the bottom wall 12D and/or the base 12B of the casing 12. The sheet metal, however, does not necessarily have to be exposed. The inner surface of the casing 12, such as the surface(s) of the bottom wall 12D and/or the base 12B that face(s) the nozzle surface 22*d*, may be subjected to a reflected light reducing process for reducing the occurrence of reflected light. The inner surface of the casing 12 may be subjected to, for example, a black anodizing process or an antireflective coating (such as a black anti-reflection coating). Alternatively, a reflected light protection member may be disposed on the surface of the sheet metal of the casing 12. Examples of the reflected light protection member include an opaque member, such as a black member. The surface of the reflected light protection member may be provided with projections and depressions. The reflected light protection member may be a spongy member including internal holes in communication with each other two-dimensionally and/or three-dimensionally. The reflected light protection member may be, for example, a foam or a velvety sheet. Specific examples of the foam include a porous material made of ethylene propylene diene monomer (EPDM) rubber. Commercially available examples of the foam include an OPSEALER® sponge and an EPTSEALER® sponge.

Figure 10:
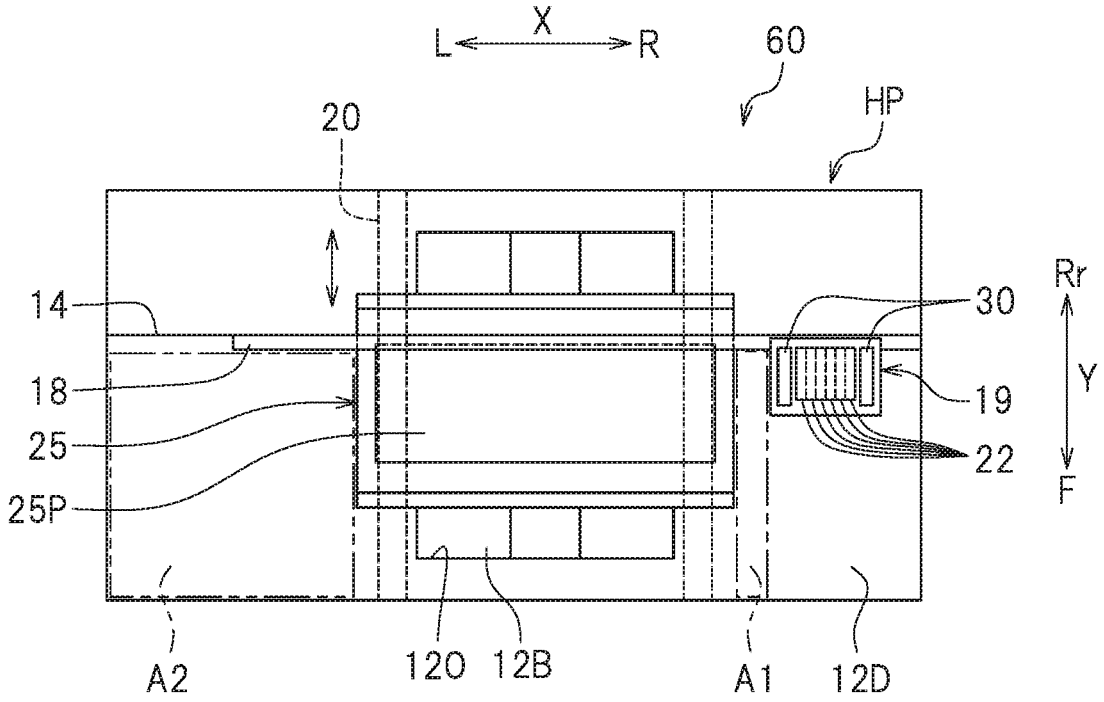
FIG. 10 is a plan view of the inside of a photo-curing inkjet printer according to a variation of a preferred embodiment of the present invention.

FIG. 10 is a plan view of the inside of a printer 60 according to a variation of the foregoing preferred embodiments. The printer 60 illustrated in FIG. 10 is similar in structure to the printer 10 illustrated in FIG. 3, except the feature described below. The printer 60 includes an EPTSEALER® sponge disposed on a region of the bottom wall 12D located rightward of the table 25 in a plan view. Specifically, this EPTSEALER® sponge is disposed on the surface of a region A1 of the bottom wall 12D located between the home position HP and the table 25. The printer 60 includes another EPTSEALER® sponge disposed on a region of the bottom wall 12D located leftward of the table 25 in the plan view. Specifically, this EPTSEALER® sponge is disposed on the surface of a region A2 of the bottom wall 12D located forward of the ink cartridge fitting portion 20. In this variation, the length of the guide rail 18 measured in the right-left direction X is longer than the length of the table 25 measured in the right-left direction X. Thus, movement of the carriage 19 to the left end or right end of the guide rail 18 may cause the light, which is applied from the UV lamps 30, to be reflected by the region A1 and/or the region A2. To cope with this, the printer 60 according to this variation includes the EPTSEALER® sponges on the regions A1 and A2 so as to reduce the occurrence of reflected light when the carriage 19 moves far beyond the width of the table 25 in the right-left direction X. Consequently, this variation more effectively reduces the amount of reflected light incident on the nozzles 22*a*.

Figure 11:
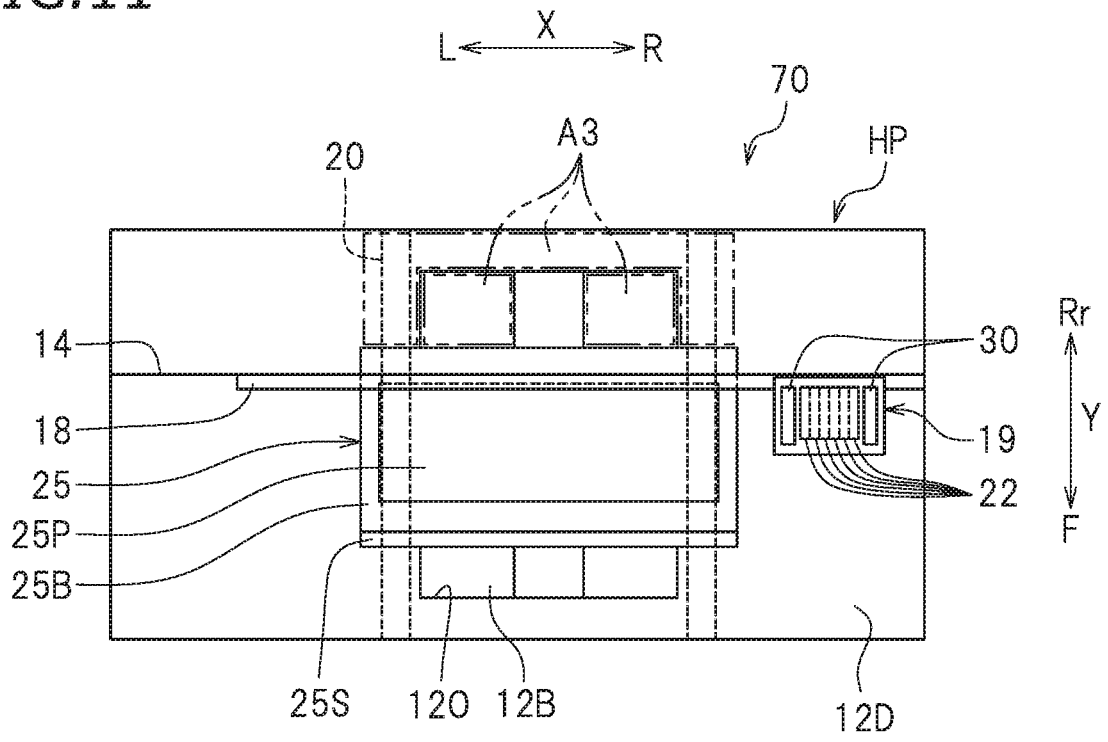
FIG. 11 is a plan view of the inside of a photo-curing inkjet printer according to another variation of a preferred embodiment of the present invention.

FIG. 11 is a plan view of the inside of a printer 70 according to another variation of the foregoing preferred embodiments. The printer 70 illustrated in FIG. 11 is similar in structure to the printer 10 illustrated in FIG. 3, except the feature described below. The table 25 of the printer 70 includes the body 25B and the start end member 25S but includes no finish end member 25E. The printer 70 includes, instead of the finish end member 25E, EPTSEALER® sponges spread over the surfaces of regions A3 of the bottom wall 12D and the base 12B (which are located rearward of the table 25 in the plan view) to the extent that does not interfere with the movement of the table 25. Such a variation is also suitable for photo-curing inkjet printers similarly to the foregoing preferred embodiments. In addition to or instead of the EPTSEALER® sponges located rearward of the table 25, EPTSEALER® sponges may be spread over the surfaces of regions of the bottom wall 12D and the base 12B that are located forward of the table 25 in the plan view. In this case, the table 25 may include no start end member 25S.

In the foregoing preferred embodiments, the table 25 includes the body 25B, the start end member 25S, and the finish end member 25E. The upper surfaces of the start end member 25S and the finish end member 25E are parallel or substantially parallel to the upper surface of the body 25B. The present invention, however, is not limited to this arrangement. The body 25B, the start end member 25S, and the finish end member 25E may be integral with each other so as to provide the table 25 having a one-piece structure. The upper surface of the start end member 25S does not necessarily have to be flush with the upper surface of the body 25B. Alternatively, the start end member 25S may be attached to the body 25B such that the upper surface of the start end member 25S is inclined relative to the upper surface of the body 25B or perpendicular or substantially perpendicular to the upper surface of the body 25B, as long as the start end member 25S does not interfere with the movement of the carriage 19. The upper surface of the finish end member 25E does not necessarily have to be flush with the upper surface of the body 25B. Alternatively, the finish end member 25E may be attached to the body 25B such that the upper surface of the finish end member 25E is inclined relative to the upper surface of the body 25B or perpendicular or substantially perpendicular to the upper surface of the body 25B, as long as the finish end member 25E does not interfere with the movement of the carriage 19.

In the foregoing preferred embodiments, the number of ink heads 22 preferably is six such that six types of ink are discharged from the ink heads 22, for example. The number of types of ink, however, is not limited to six. The ink heads 22 may discharge any number of types of ink. The ink heads 22 do not necessarily have to include, for example, the ink head(s) 22 to discharge white ink and/or gloss ink. The number of ink heads 22 is not limited to any particular number. The number of ink heads 22 may be, for example, five or less or may be, for example, seven or more. The ink heads 22 may be disposed in a "staggered arrangement" in which the ink heads 22 are deviated from each other in the front-rear direction Y.

In the foregoing preferred embodiments, the photo-curable ink is UV ink, and the printer 10 includes the UV lamps 30 each functioning as the light applicator. The photo-curable ink, however, is not limited to UV ink. The photo-curable ink may be any suitable ink other than UV ink. The photo-curable ink may be cured upon being irradiated with, for example, X-rays, visible rays, or infrared rays. In this case, the printer 10 may include, in addition to or instead of the UV lamps 30, an x-ray source, a fluorescent lamp (which is a type of low-pressure mercury lamp), a high-pressure mercury lamp, or an infrared lamp.

In the foregoing preferred embodiments, one of the two UV lamps 30 is disposed rightward of the ink heads 22, and the other one of the two UV lamps 30 is disposed leftward of the ink heads 22. Alternatively, any other number of UV lamps 30 may be disposed at any suitable locations. The number of UV lamps 30 may be one or may be three or more. The UV lamp(s) 30 may be disposed either rightward or leftward of the ink heads 22. The UV lamp(s) 30 and the ink heads 22 do not necessarily have to be mounted on the same carriage. In one example, the UV lamp(s) 30 may be mounted on the carriage 19, and the ink heads 22 may be mounted on another carriage. In another example, the ink heads 22 may be mounted on the carriage 19, and the UV lamp(s) 30 may be mounted on another carriage. The UV lamp(s) 30 may be directly or indirectly attached to the wall surface(s) of the casing 12 (e.g., the rear wall 12Rr and/or the upper wall 12U).

The foregoing preferred embodiments have been described on the assumption that the printer 10 is of a "shuttle type (or serial type)" in which the ink heads 22 are mounted on the carriage 19 so as to effect printing while the ink heads 22 are reciprocated (or shuttled) in the right-left direction X. The present invention, however, may be applied to any other suitable types of printers. The techniques disclosed herein are similarly usable for a "line printer" that includes, for example, a line head similar in width to the substrate 25*a* and effects printing, with the line head fixed.

In the foregoing preferred embodiments, the printer 10 is configured to move the carriage 19 in the right-left direction X and move the table 25 in the front-rear direction Y. The carriage 19 and the table 25, however, may move in any other suitable directions as long as the carriage 19 and the table 25 move relative to each other. One of the carriage 19 and the table 25 may move in the right-left direction X, and the other one of the carriage 19 and the table 25 may move in the front-rear direction Y. Alternatively, the table 25 may be disposed immovably, and the carriage 19 may be movable in both of the right-left direction X and the front-rear direction Y.

The techniques disclosed herein are usable for various types of inkjet printers. The printer 10 does not necessarily have to be an independent printer to be used alone. The printer 10 may be used in combination with other device(s). The printer 10 may include, for example, a cutting head to cut the substrate 25*a*.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A photo-curing inkjet printer comprising:

a casing including a bottom wall;

a bed on which a substrate is to be placed, the bed being disposed above the bottom wall and including a printable region;

a discharger disposed above the bed to discharge photo-curable ink in the printable region and onto the substrate placed on the bed;

a light applicator disposed above the bed to apply light to the photo-curable ink discharged onto the substrate;

a conveyor to convey one of the bed and the discharger relative to the other one of the bed and the discharger in a conveyance direction; and a controller to control the discharger, the light applicator, and the conveyor; wherein a length of the bottom wall is longer than a length of the bed in the conveyance direction;

the discharger includes a row of nozzles aligned in the conveyance direction to discharge the photo-curable ink;

a length of the bed measured from a start end of the bed to a start end of the printable region is longer in the conveyance direction than a length calculated by subtracting a maximum pass width from a length of the row of nozzles of the discharger; and the length of the bed measured from the start end of the bed to the start end of the printable region is equal to or shorter than a length of the light applicator in the conveyance direction.

2. The photo-curing inkjet printer according to claim 1, wherein the conveyor moves the bed relative to the discharger in the conveyance direction.

3. The photo-curing inkjet printer according to claim 1, wherein the bed is smaller in area than the bottom wall.

4. The photo-curing inkjet printer according to claim 1, wherein a length of the bed measured from a finish end of the bed to a finish end of the printable region is longer in the conveyance direction than the length of the row of nozzles of the discharger.

5. The photo-curing inkjet printer according to claim 1, further comprising a reflected light protector disposed between the start end of the bed and the start end of the printable region to reduce reflected light incident on the discharger.

6. The photo-curing inkjet printer according to claim 1, wherein the bed includes:

a body on which the printable region is located; and a start end member attached to a start end of the body facing in the conveyance direction.

7. The photo-curing inkjet printer according to claim 1, wherein the length of the bed measured from the start end of the bed to the start end of the printable region is longer than a length of a lower surface of the discharger in the conveyance direction.

8. The photo-curing inkjet printer according to claim 1, further comprising:

a guide rail disposed above the bed and extending in a scanning direction perpendicular or substantially perpendicular to the conveyance direction; and a carriage slidable along the guide rail and equipped with the discharger and the light applicator.

* * * * *